US008154263B1

(12) United States Patent
Shi et al.

(10) Patent No.: US 8,154,263 B1
(45) Date of Patent: Apr. 10, 2012

(54) CONSTANT GM CIRCUITS AND METHODS FOR REGULATING VOLTAGE

(75) Inventors: Zhouyuan Shi, Santa Clara, CA (US); Stephen Leeboon Wong, Saratoga, CA (US)

(73) Assignee: Marvell International Ltd., Hamilton (BM)

( * ) Notice: Subject to any disclaimer, the term of this patent is extended or adjusted under 35 U.S.C. 154(b) by 429 days.

(21) Appl. No.: 12/255,468

(22) Filed: Oct. 21, 2008

Related U.S. Application Data

(60) Provisional application No. 60/985,734, filed on Nov. 6, 2007.

(51) Int. Cl.
*G05F 1/59* (2006.01)

(52) U.S. Cl. ..... 323/269; 323/277; 323/280

(58) Field of Classification Search ..... 323/269, 323/273, 274, 277, 280
See application file for complete search history.

(56) References Cited

U.S. PATENT DOCUMENTS

| | | | | |
|---|---|---|---|---|
| 5,559,423 | A * | 9/1996 | Harman | 323/277 |
| 5,939,867 | A * | 8/1999 | Capici et al. | 323/277 |
| 6,522,111 | B2 * | 2/2003 | Zadeh et al. | 323/277 |
| 6,573,694 | B2 * | 6/2003 | Pulkin et al. | 323/273 |
| 6,603,292 | B1 * | 8/2003 | Schouten et al. | 323/277 |
| 7,843,180 | B1 * | 11/2010 | Cilingiroglu | 323/274 |
| 2008/0231243 | A1 * | 9/2008 | Zhong et al. | 323/273 |

* cited by examiner

*Primary Examiner* — Jeffrey Sterrett

(57) ABSTRACT

In one embodiment the present invention includes a voltage regulator circuit comprising a voltage to current converter. The voltage to current converter is coupled to provide a current to maintain an output voltage under changing load conditions. A transconductance of the voltage to current converter is independent of the output current and therefore improves stability for the voltage regulator across load conditions.

20 Claims, 8 Drawing Sheets

CONSTANT GM CIRCUITS AND METHODS FOR REGULATING VOLTAGE

CROSS REFERENCE TO RELATED APPLICATIONS

This application is a non-provisional of and claims the benefit of priority from U.S. Patent Application No. 60/985,734, filed Nov. 6, 2007, entitled "Constant GM LDO" the disclosure of which is hereby incorporated herein by reference.

BACKGROUND

The present invention relates to voltage regulators, and in particular, to circuits and methods for regulating voltage using constant transconductance.

Low drop out (LDO) regulators are important power management building blocks. This is especially true for portable applications such as cellular phones, personal digital assistants (PDAs), and digital cameras.

Many LDO regulators employ metal oxide semiconductor (MOS) technology in order to reduce the quiescent current of the device. Power transistors such as power P-channel MOS field effect transistors (FET) are used to supply the regulated voltage by using the transistor to pass current to the load. The transconductance ($g_m$) of the output P-channel power FET typically changes with the square root of the load current ($I_{load}$).

This square root dependence of $g_m$ on $I_{load}$ may limit the stability of the voltage regulator. For example, for some LDO regulators the output stability is dependent on an output capacitor. FIG. 1A illustrates a prior art LDO regulator 100 which uses capacitor $C_{load}$ 106 to stabilize the output $V_{out}$ 102. FIG. 1B illustrates a graph 120 having frequency plots 121-123 depicting the loop gain associated with different loading of the prior art LDO voltage regulator 100 of FIG. 1A. The frequency at which the loop gain crosses 0 dB is known as the unity gain bandwidth (GBW), and is proportional to $g_m/C_{load}$ in this topology. Because $g_m$ increases with $I_{load}$. The GBW also increases with $I_{load}$.

Frequency plot 121 illustrates a condition in which load 108 of LDO regulator 100 of FIG. 1A is an open circuit (i.e. no load) condition. Frequency plot 121 illustrates a pole frequency 124 (indicated with dashed line) corresponding to an internal node of the LDO that will not change with load current. Since the pole (i.e. intersection of dashed line and frequency plot 121) is below the 0 dB axis, the LDO regulator 100 is stable for the no load condition.

Frequency plot 122 illustrates a condition in which a load current ("$I_{load}$") of LDO regulator 100 of FIG. 1A is a load greater than the load corresponding to frequency plot 121. Frequency plot 122 illustrates the changes associated with increasing $I_{load}$, and the corresponding increase in $g_m$, cause the zero dB frequency to increase. Since the gain bandwidth (GBW) frequency of the LDO loop is proportional to $g_m/C_{load}$, the GBW frequency increases towards the pole frequency 124. However, since the pole frequency 124 is still below the 0 dB axis, the LDO regulator 100 remains stable for this load condition.

Frequency plot 123 illustrates a condition in which load 108 of LDO regulator 100 of FIG. 1A draws a load current that is greater than the load current corresponding to frequency plot 122. Frequency plot 123 illustrates how the corresponding change in $g_m$ increases such that the loop gain at pole frequency 124 is above the 0 dB axis. The LDO regulator 100 becomes unstable for this load condition.

Increasing the value of $C_{load}$ to limit the GBW may stabilize LDO regulator 100. However, this may result in an oversized (or expensive) capacitor being used. This may also result in poorer transient response due to the lower bandwidth.

Prior art solutions to this problem rely on additional circuitry for generating an internal zero to cancel the pole that also varies with the load current. This zero tracks the GBW and provides additional phase to keep the loop stable over the entire load current range. One disadvantage of this technique, however, is that forcing the two frequencies to track each other over all conditions is not easy, and sometimes requires complex and expensive additional circuitry. Furthermore, if tracking is not maintained, it may result in undesirable pole-zero frequency doublets that can degrade the LDO's transient response.

FIG. 1C illustrates another prior art LDO regulator 130 which uses Miller compensation capacitor $C_c$ 138 to stabilize the output $V_{out}$ 102. This approach suffers from similar problems described in connection with the circuit of FIG. 1A. FIG. 1D illustrates a graph 140 having frequency plots 141-143 depicting the loop gain associated with different load currents of the prior art LDO voltage regulator 130 of FIG. 1C.

The Miller compensation capacitor $C_c$ 138 "splits" the internal poles of LDO regulator 130 into a low frequency dominant pole, and a $2^{nd}$ order pole that is proportional to $g_m/C_{load}$ where $g_m$ again is a function of the load current. Frequency plot 141 illustrates a problem in the no load or light load condition when $g_m$ may be very small or zero. The $2^{nd}$ order pole 144 of frequency plot 141 now becomes very small due to the fact that the output stage (e.g., $g_m$) is not strong enough to "split the poles". In this case the $2^{nd}$ order pole 144 can become lower than the GBW resulting in insufficient phase margin for stability.

Frequency plot 141 illustrates the no load condition of LDO regulator 130 of FIG. 1C. Frequency plot 141 illustrates how the $2^{nd}$ order pole becomes lower such that pole frequency is above the 0 dB axis and LDO regulator 130 becomes unstable for this load condition.

Stabilizing the LDO regulator 130 may rely on biasing the output stage with a minimum current. This may be accomplished using the current in the LDO regulator 130 resistive divider (i.e. the current through resisters 134 and 135). This may also be accomplished using a special current buffering scheme that pushes the $2^{nd}$ order pole to a higher frequency even at $I_{load}$=0. Another method may consist of adding a buffer amplifier which replaces the GM stage as the output stage. This may be a source or emitter follower. These approaches are undesirable because of the increased quiescent current to the LDO regulator 130.

Thus, there is a need for improved regulators. The present invention solves these and other problems by providing regulators with constant transconductance circuits.

SUMMARY

Embodiments of the present invention include regulation techniques with constant transconductance ("GM").

In one embodiment, the present invention includes a voltage regulator circuit. The voltage regulator includes an input terminal coupled to receive an input voltage, an output terminal coupled to a load, a gain stage, and a voltage to current converter. The gain stage has a first input coupled to a reference voltage, a second input coupled to the output terminal of the regulator, and an output terminal for providing a difference signal between the reference voltage and a regulator output voltage. The voltage to current converter has a first input coupled to the input terminal of the regulator for receiving the input voltage, a second input coupled to the output terminal of the gain stage, and an output coupled to the regulator output terminal for providing a output current into the load. The transconductance of the voltage to current converter is constant across a range of values of the output current.

In one embodiment, the gain stage comprises a differential output.

In one embodiment, the voltage to current converter includes a feedback network coupled to provide a feedback signal corresponding to the current.

In one embodiment, the feedback network includes a resistor.

In one embodiment, the feedback network includes a resistor, and wherein the gain circuit includes differential outputs coupled to an amplifier in the voltage to current converter, and wherein the feedback network includes differential outputs coupled to the amplifier, and wherein the transconductance of the voltage to current converter is inversely proportional to the value of the resistor.

In one embodiment, the voltage to current converter comprises an amplifier, a resistor, and a transistor. The amplifier has a first input coupled to the output terminal of the gain stage, a second input, and an output. The resistor has a first terminal coupled to the input terminal of the regulator and a second terminal coupled to the second input of the amplifier. The transistor has a control terminal coupled to the output of the amplifier, a first terminal coupled to the second terminal of the resistor, and a second terminal coupled to the output terminal of the regulator.

In one embodiment, the regulator further comprises a second transistor having a control terminal coupled to the output of the amplifier, a first terminal coupled to the input terminal of the regulator, and a second terminal coupled to the output terminal of the regulator.

In one embodiment, the regulator further comprises a capacitor having a first terminal coupled to the first input of the amplifier and a second terminal coupled to the output of the regulator.

In one embodiment, the voltage to current converter comprises a network, a second voltage to current converter, an amplifier, and a transistor. The network is coupled to the input terminal of the regulator, the network generating a voltage proportional to the output current. The second voltage to current converter is coupled to the network for receiving the voltage proportional to the output current. The amplifier is coupled to receive an output of the second voltage to current converter. The transistor has a control terminal couple to an output of the amplifier, a first terminal coupled to the network, and a second terminal coupled to the output terminal of the regulator, and the gain stage is a third voltage to current converter. The difference signal is a difference current, where current from the second voltage to current converter is combined with current from the third voltage to current converter at the input of the amplifier.

In one embodiment, the network comprises a first resistor. Additionally, the second voltage to current converter comprises a first transistor, a second transistor, a second resistor, and a third resistor, the first transistor having a control terminal coupled to the first resistor, a first terminal coupled to the input terminal of the regulator, and a second terminal coupled to a first input of the amplifier through the second resistor, the second transistor having a control terminal and a first terminal coupled to the input terminal of the regulator and a second terminal coupled to a second input of the amplifier through the third resistor. Furthermore, the gain stage comprises a third transistor and fourth transistor, wherein the third transistor has a control terminal coupled to the output terminal of the regulator and a first terminal coupled to the first input of the amplifier, and wherein the fourth transistor has a control terminal coupled to the reference voltage and a first terminal coupled to the second input of the amplifier.

In one embodiment, the second input of the gain stage is coupled to the output terminal of the regulator through a resistor divider.

In another embodiment, the present invention includes a method comprising receiving an input voltage an input terminal of a regulator, the regulator generating an output voltage, coupling a reference voltage and the output voltage to a gain stage, and in accordance therewith, generating a difference signal, converting the input voltage to an output current of the regulator, wherein the output current is proportional to a difference between the input voltage and the difference signal, wherein a transconductance of the conversion of the input voltage to the output current is constant across a range of values of the output current.

In one embodiment, the method further comprises amplifying the output current.

In one embodiment, the difference signal is a differential signal.

In one embodiment, the difference signal is a voltage.

In one embodiment, the difference signal is a current, such as a differential current, for example.

In one embodiment, converting the input voltage to the output current comprises coupling the input voltage and output voltage across a feedback network.

In one embodiment, the feedback network includes a resistor.

In one embodiment, a transconductance of the conversion is inversely proportional to the value of the resistor.

In one embodiment, converting comprises coupling an input current of the regulator through a resistor to generate a first voltage, coupling the input current of the regulator through a transistor, and controlling a control terminal of the transistor using a difference between the first voltage and the difference signal.

In one embodiment, the difference signal is a current, and wherein the converting comprises coupling an input current of the regulator through a network to generate a first voltage proportional to the output current, coupling the input current of the regulator through a transistor, converting the first voltage to a first current, and combining said current difference signal and the first current to generate a control signal for controlling a control terminal of the transistor.

In one embodiment, the first current is a differential current, wherein the current difference signal is a differential current, and wherein the combined current difference signal and first current are amplified to generate a control voltage.

In another embodiment, the present invention includes a circuit comprising means for converting an input current received at the input of a regulator into a voltage and means for amplifying a difference between a reference voltage and an output voltage of the regulator or a voltage coupled to the output voltage of the regulator to produce a difference signal. The circuit further includes means for converting the input voltage to an output current of the regulator, where the output current is proportional to a difference between the input voltage and the difference signal, wherein a transconductance of the conversion of the input voltage to the output current is constant across a range of values of the output current.

In one embodiment, the present invention further includes means for amplifying the output current.

In one embodiment, the present invention further includes means for generating a differential voltage from an input current received at the input of the regulator, means for generating a differential difference signal, and means for amplifying a difference between the differential signals to control a transistor, where the transistor generates an output current of the regulator.

In one embodiment, the present invention includes means for converting the differential voltage into a differential current, means for generating a differential current difference signal, and means for combining the differential currents. The circuit may also include means for amplifying the combined differential currents to control a transistor, where the transistor generates an output current of the regulator.

In one embodiment, the circuit includes means for generating a voltage that is proportional to the input current of the regulator, and generating a differential current from the voltage. The circuit further includes means for generating a differential current from the output voltage and a reference signal. Additionally, the circuit includes means for amplifying the combined currents to produce a voltage for controlling a transistor, where the transistor generates an output current of the regulator.

The following detailed description and accompanying drawings provide a better understanding of the nature and advantages of the present invention.

DETAILED DESCRIPTION

Described herein are techniques for constant transconductance regulators. In the following description, for purposes of explanation, numerous examples and specific details are set forth in order to provide a thorough understanding of the present invention. It will be evident, however, to one skilled in the art that the present invention as defined by the claims may include some or all of the features in these examples alone or in combination with other features described below, and may further include modifications and equivalents of the features and concepts described herein.

Embodiments of the present invention include incorporating a V-to-I converter whose transconductance gain (GM), either single-ended or differential, is constant over a wide range of load current $I_{load}$. This technique helps ensure that common output stage frequency parameters that are normally dependent on $GM/C_{load}$, such as unity gain bandwidths or second order poles, remain roughly independent (to first order) of the load current. This can significantly improve the stability of such regulators over a wide range of $I_{load}$, and indirectly, over a wide range of $C_{load}$ as well.

Figure 1A:
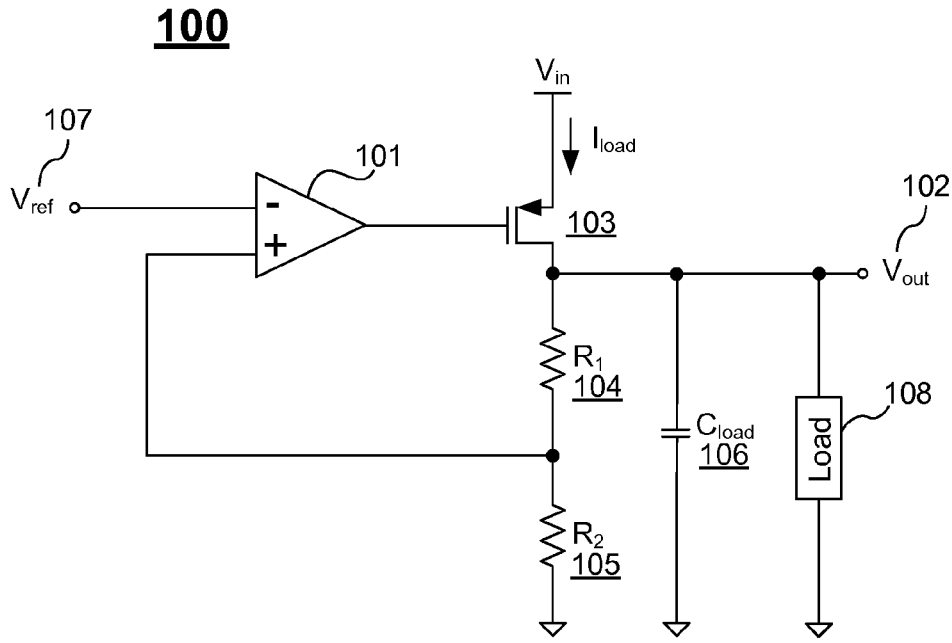
Fig. 1A (Prior Art)
FIG. 1A illustrates a prior art LDO voltage regulator.
Figure 1B:
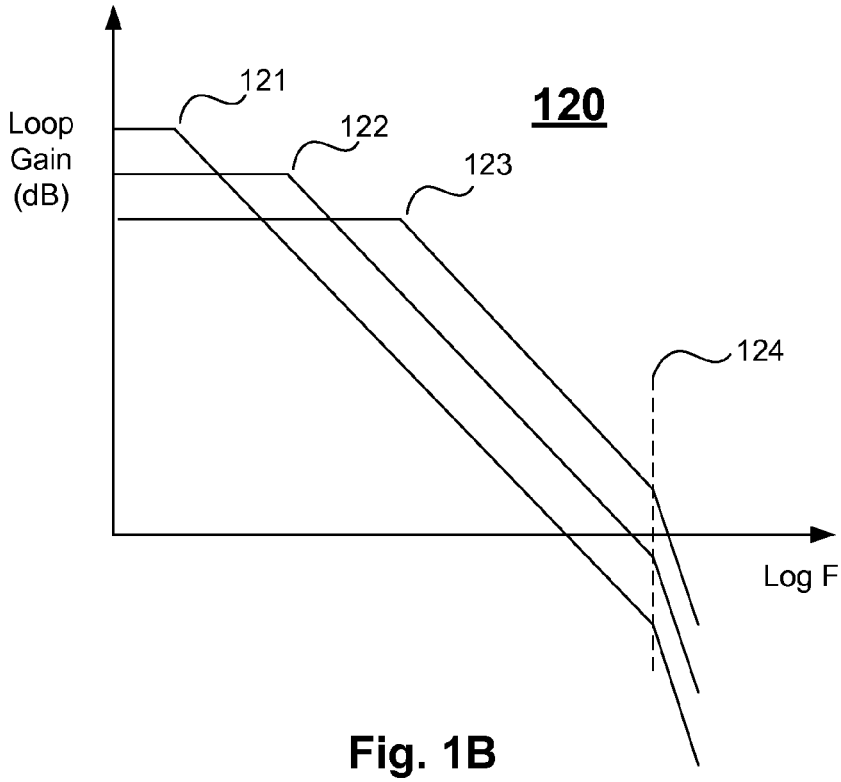
Fig. 1B (Prior Art)
FIG. 1B illustrates a graph of frequency plots associated with different loading of the prior art LDO voltage regulator of FIG. 1A.
Figure 1C:
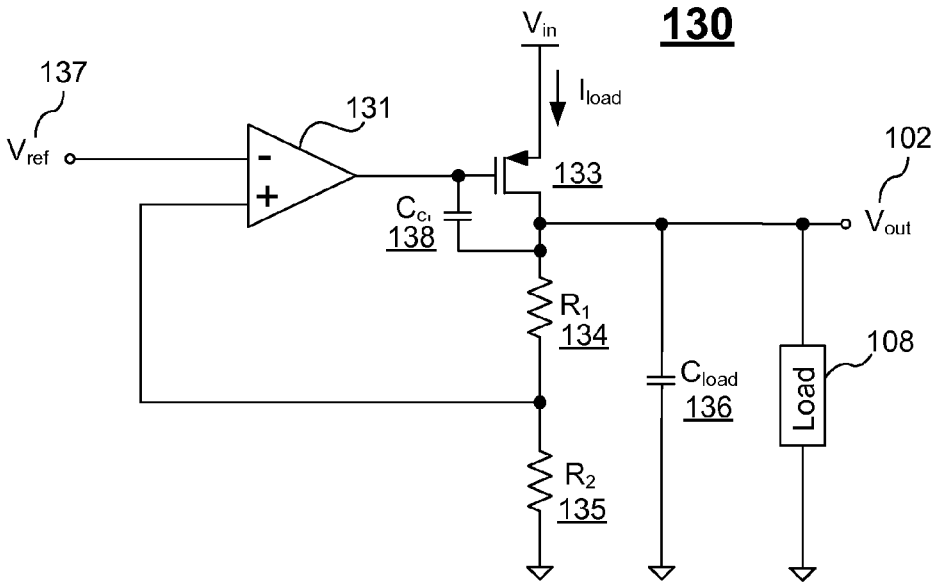
Fig. 1C (Prior Art)
FIG. 1C illustrates another prior art LDO voltage regulator.
Figure 1D:
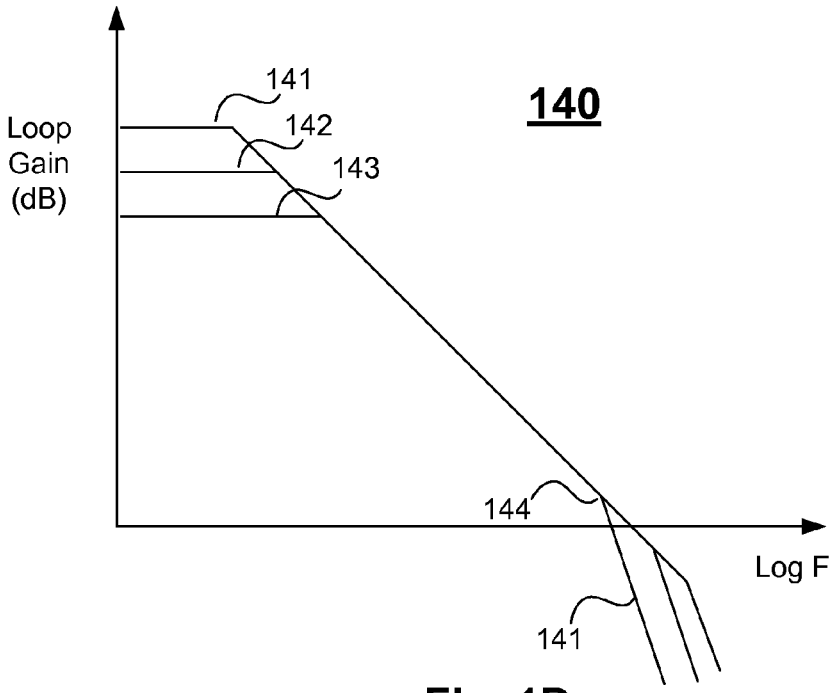
Fig. 1D (Prior Art)
FIG. 1D illustrates a graph of frequency plots associated with different loading of the prior art LDO voltage regulator of FIG. 1C.
Figure 2:
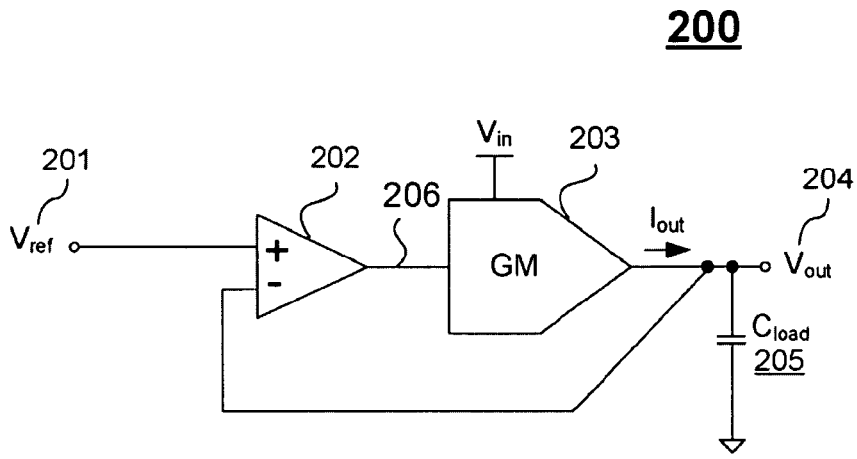
FIG. 2 illustrates a regulator according to one embodiment of the present invention.

FIG. 2 illustrates a regulator 200 according to one embodiment of the present invention. Regulator 200 includes a voltage to current converter (V-to-I converter), gain stage 202, and load capacitor ($C_{load}$) 205. The V-to-I converter includes constant transconductance stage 203 (GM stage). Load capacitor ($C_{load}$) 205 may stabilize the LDO regulator 200. The V-to-I converter is coupled to receive the regulator input voltage and provide a current $I_{out}$.

$V_{ref}$ 201 may be a reference voltage used in establishing the output voltage ($V_{out}$) 204 of the regulator 200. Gain stage 202 may generate a difference signal corresponding to the difference between $V_{ref}$ 201 and $V_{out}$ 204. Gain stage may further provide gain, which is used here in the broad sense to include positive gain (e.g., amplification), negative gain (e.g., attenuation), and unity gain (e.g., X1). The difference signal (e.g., a voltage, $\Delta V_{error}$) 206 or "error signal" between the desired voltage level $V_{ref}$ 201 and the present $V_{out}$ 204 may be gained up and coupled to GM stage 203, for example. It is to be understood that different implementations may include both single-ended or differential "error signals."

In this embodiment, GM stage 203 converts the input voltage Vin to a current $I_{out}$. The small-signal transconductance ($GM=\Delta I_{out}/\Delta V_{in}$) may be independent of the direct current (DC) value of the load current $I_{out}$. $I_{out}$ may vary according to a load (not shown), but the transconductance (i.e. GM) may remain constant across the load variations. The unity gain bandwidth of the regulator is proportional to $GM/C_{load}$. The unity gain bandwidth may remain independent of the load current over a wide range of $I_{out}$, and therefore, the LDO may remain stable over the same range.

Figure 3:
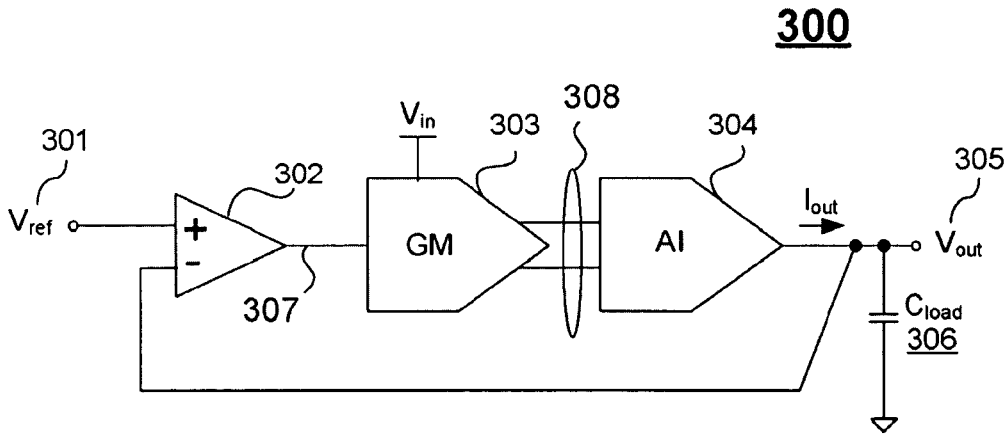
FIG. 3 illustrates a regulator according to another embodiment of the present invention.

FIG. 3 illustrates a regulator 300 according to another embodiment of the present invention. Regulator 300 includes a voltage to current converter (V-to-I converter), gain stage 302, and load capacitor ($C_{load}$) 305. The V-to-I converter includes constant transconductance stage 303 (GM stage) and current gain stage (AI stage) 304. Load capacitor ($C_{load}$) 306 may stabilize the LDO regulator 300. The V-to-I converter is coupled to the AI stage receive the regulator input voltage and to provide a current $I_{out}$.

Regulator 300 operates similar to regulator 200 of FIG. 2 with the exception of the current gain. In this embodiment, the output stage is a current gain stage 304 whose small-signal current gain ($AI=\Delta I_{out}/\Delta I_{in}$) is independent of the DC value of the load current $I_{out}$. The AI stage 304 is preceded by a constant transconductance stage 303 (e.g., a V-to-I converter to generate a large signal constant transconductance), which converts the regulator input voltage to $\Delta I_{in}$ 308. GM may be constant and therefore independent of load current $I_{out}$ variations. The unity gain bandwidth of the regulator is proportional to AI*GM/$C_{load}$. The unity gain bandwidth may remain independent of the load current over a wide range of $I_{out}$, and therefore, the regulator may remain stable over the same range.

Figure 6A:
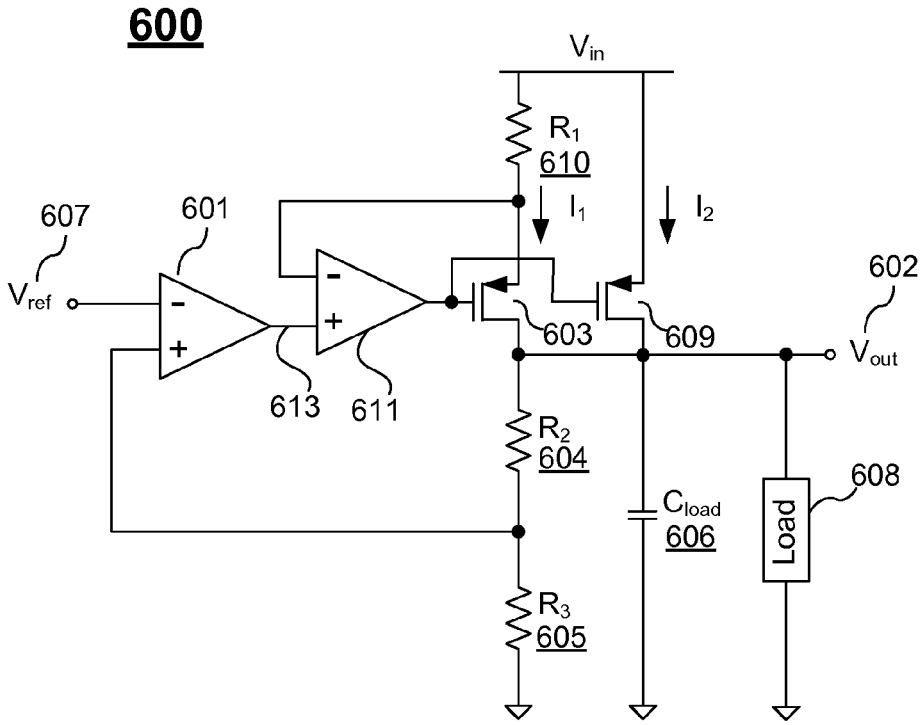
FIG. 6A illustrates a regulator according to another embodiment of the present invention.

The AI stage 304 could be any kind of current mirroring or current amplifying stage provided that the gain AI can remain relatively constant over the range of load current that is of interest. On common example of such a current mirroring stage can be found at the output stage of V-to-I converter 612 of FIG. 6A described below. Referring to FIG. 6A, by maintaining the IR drop across resistor R1 small compared to the VGS of either PMOS device 603 and 609, the total output current $I_2+I_1$ would be a amplified version of the input current $I_1$ which is also the output current of the previous V-to-I converter stage. The size of PMOS 609 is typically made many times (say m) that of PMOS 603, thus the gain AI can easily be expressed as a large number equaling m+1.

Figure 4:
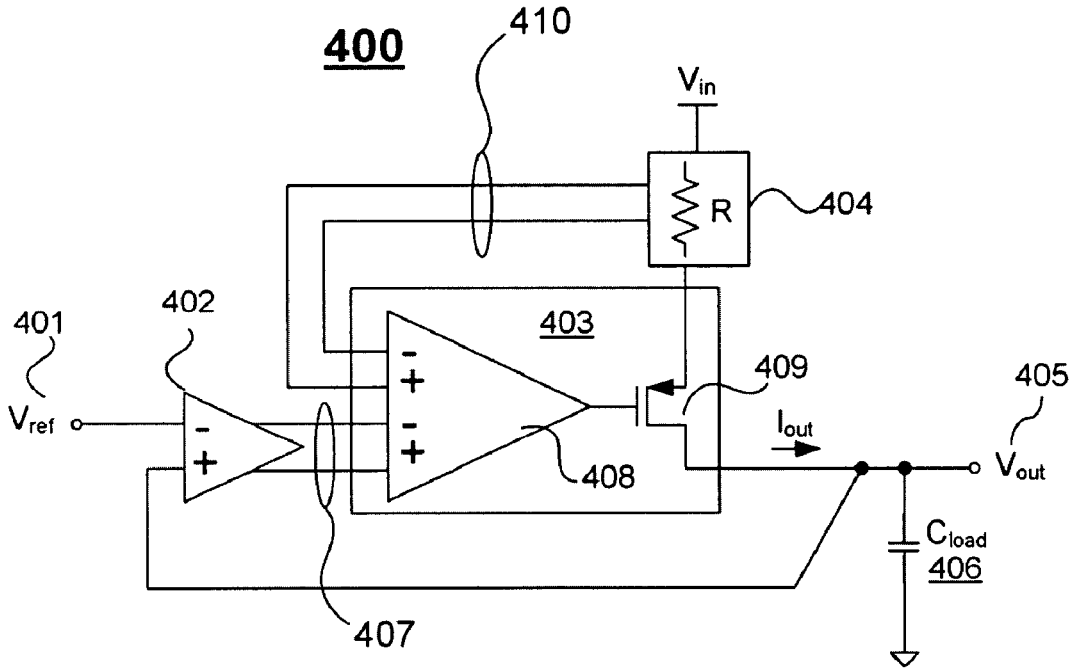
FIG. 4 illustrates a regulator according to another embodiment of the present invention.

FIG. 4 illustrates a regulator 400 according to another embodiment of the present invention. This embodiment shows one specific example implementation of circuit 200 depicted in FIG. 2. Regulator 400 includes a high gain dual differential input voltage to current converter 403 (V-to-I converter), which that is not necessarily constant GM, a feedback network 404 comprising of a linear element such as a resistor, gain stage 402, and load capacitor ($C_{load}$) 406. By applying feedback such that the output current $I_{out}$ also flows into linear feedback network 404, the output of that network 410 will be linearly proportional to $I_{out}$. Since output 410 and input voltage 407 are both applied to the differential input of V-to-I converter 403, it is necessary that voltage 410 matches the input voltage 407 when the gain of 403 is high enough. When this happens, the output current $I_{out}$ is forced to be linearly proportional to input voltage 407. Thus the network comprising of V-to-I converter 403 and linear feedback network 404 constitutes a method of implementing a V-to-I converter with GM that is independent of the DC value of the load current $I_{out}$. In this embodiment, the V-to-I converter may have a transconductance (GM) that is inversely proportional to the resistor R. GM may then be independent of the DC value of the load current $I_{out}$.

$V_{ref}$ 401 may be a reference voltage that may be used to control the output voltage of the regulator 400. Gain stage 402 may provide gain to the difference between $V_{ref}$ 401 and the output voltage ($V_{out}$) 405. The gained up difference voltage ($\Delta V_{error}$) 407 or amplified "error signal" between the desired voltage level $V_{ref}$ 401 and the present $V_{out}$ 405 may be gained up and coupled to GM stage 403.

Figure 5A:
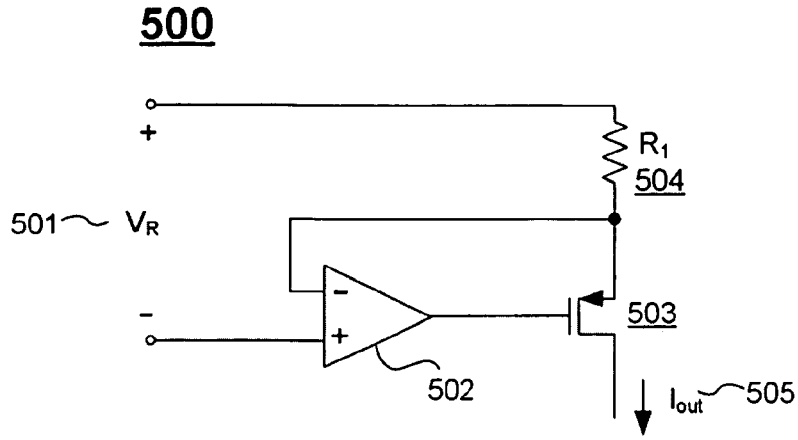
FIG. 5A illustrates an example constant GM circuit.

FIG. 5A illustrates an example constant GM circuit 500. This circuit may be used to generate a linear dependence between the voltage $V_{in}$ 501 and output current $I_{out}$ 505. Circuit 500 includes amplifier 502, transistor 503, and resistor 504. Amplifier 502 provides a negative feedback to set up an output current $I_{out}$ 505 corresponding to input voltage $V_R$ 501 and the value of resistor 504. Circuit 500 is a special single-ended implementation of the constant GM circuit described in FIG. 4 where the feedback linear network 404 comprises of a single resistor.

Amplifier 502 may stabilize to at an output voltage which will produce an output current $I_{out}$ 505 which will maintain approximately zero volts between the two input terminals of amplifier 502. Therefore, the value of voltage $V_R$ 501 will be across resistor 504 and $I_{out}$ 505 will have a linear dependence to voltage $V_R$ 501.

Figure 5B:
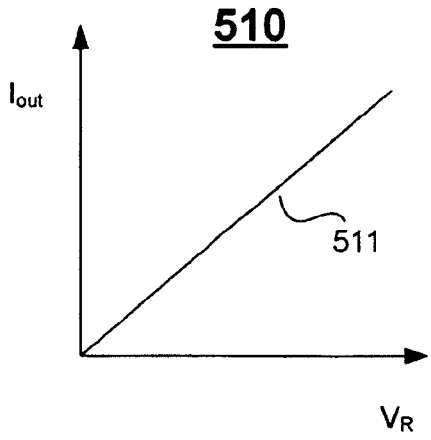
FIG. 5B illustrates a graph of the voltage to current characteristic of the circuit of FIG. 5A.

FIG. 5B illustrates a graph 510 of the voltage to current characteristic of the circuit of FIG. 5A. Graph 510 has a linear slope 511 corresponding to the value of resistor 505 of FIG. 5A.

Figure 5C:
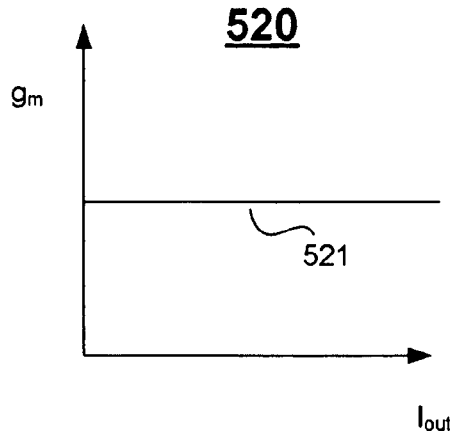
FIG. 5C illustrates a graph of the transconductance versus the output current of the circuit of FIG. 5A.

FIG. 5C illustrates a graph of the transconductance (GM) versus the output current $I_{out}$ 505 of the circuit of FIG. 5A. Transconductance (i.e. GM) is the derivative of graph 510 (i.e. $dI_{out}/dV_R$). Since graph 510 has a linear slope 511, the transconductance will be a constant line 510 across $I_{out}$ 505. Since $I_{out}$ 505 does not effect GM, GM is independent of $I_{out}$ 505. An independent GM may allow for improved stability as described above. Note that this technique may also be used to improve stability over a limited range of $I_{out}$ of interest. It is not necessary to apply the technique of maintaining constant GM over the entire range of current starting at zero.

FIG. 6A illustrates a regulator 600 according to another embodiment of the present invention. This embodiment shows one specific example implementation of circuit 300 depicted in FIG. 3. Regulator 600 includes a V-to-I converter including a current gain stage, a voltage gain stage 601, and load capacitor ($C_{load}$) 606. In this example, voltage to current conversion and current gain are implemented using amplifier 611, transistors 603 and 609, and resistor 610. Load 608 illustrates a load that may vary. For example, portable electronic devices such as cellular phones have different current loads depending on the current state of the electronic device. When not in use the phone may go into a "sleep mode" which draws only a few microamperes of current. When the phone is "ringing" the phone may be presenting a load of several hundred milliamps.

LDO regulator 600 operates similar to LDO regulator 400 of FIG. 4 described above. V-to-I converter 612 incorporates the circuit 500 of FIG. 5 to establish a constant GM for this embodiment and also shows a configuration of output transistors which may be used to improve performance.

$V_{out}$ 602 is divided down by resistors 604 and 605. One terminal of resistor 604 is coupled to $V_{out}$ 602 and the other terminal is coupled to the non-inverting terminal of gain stage 601 and one terminal of resistor 605. The other terminal of resistor 605 is coupled to a reference voltage such as ground, for example.

$V_{ref}$ 607 may be a reference voltage used to control the output voltage $V_{out}$ 602 of the regulator 600. Gain stage 601 may provide gain to the difference between $V_{ref}$ 607 and the divided voltage corresponding to the output voltage ($V_{out}$) 602. The difference voltage (i.e. error signal) between the desired voltage level $V_{ref}$ 607 and the divided voltage may be gained up and coupled to V-to-I converter 612.

V-to-I converter 612 includes amplifier 611, resistor 610, and transistor 603. Transistor 609 is included to boost the output current as described by current multiplying block AI 304 of FIG. 3. The non-inverting terminal of amplifier 611 is coupled to receive the error signal 613 and the inverting terminal of amplifier 611 is coupled to a first terminal of transistor 603 and one terminal of resistor 610. The other terminal of resistor 610 is coupled to the regulator input terminal to receive a regulator input voltage $V_{in}$. The output terminal of amplifier 611 is coupled to the control terminals of transistors 603 and 609. The first terminal of transistor 609 is coupled to $V_{in}$. The second terminals of transistors 603 and 609 are coupled to the output terminal of the regulator to provide a regulated voltage $V_{out}$ 602.

Transistor 603, amplifier 611, and resistor 610 provide a constant GM similar to circuit 500 described above. An error voltage ($\Delta V_{error}$) 613 is converted to an output current $I_1$. GM is constant and the output voltage $V_{out}$ 602 may rise due to an increase in current. $V_{out}$ 602 is divided down. The error signal is reduced. The current $I_1$ is adjusted such that $V_{out}$ 602 is at a predetermine value determined by $V_{ref}$ 607 and the voltage divider (i.e. resister 604 and 605).

This example includes an optional additional technique for increasing the load current generated by the V-I converter. In this example, transistor 609 is coupled in parallel with transistor 603. This acts to multiply the output current and the output GM. Transistor 603 may be smaller than transistor 609. In this configuration, the current passing through transistor 609 may be a multiple of the current passing through transistor 603. This may improve the current capability of regulator 600. The GM may be fairly constant over the $I_{load}$ range of interest (e.g. within 10%) provided resistor 610 is sized such that the voltage drop across it is small (e.g. <200 mV) relative to the nominal $V_{GS}$ of transistor 609.

Figure 6B:
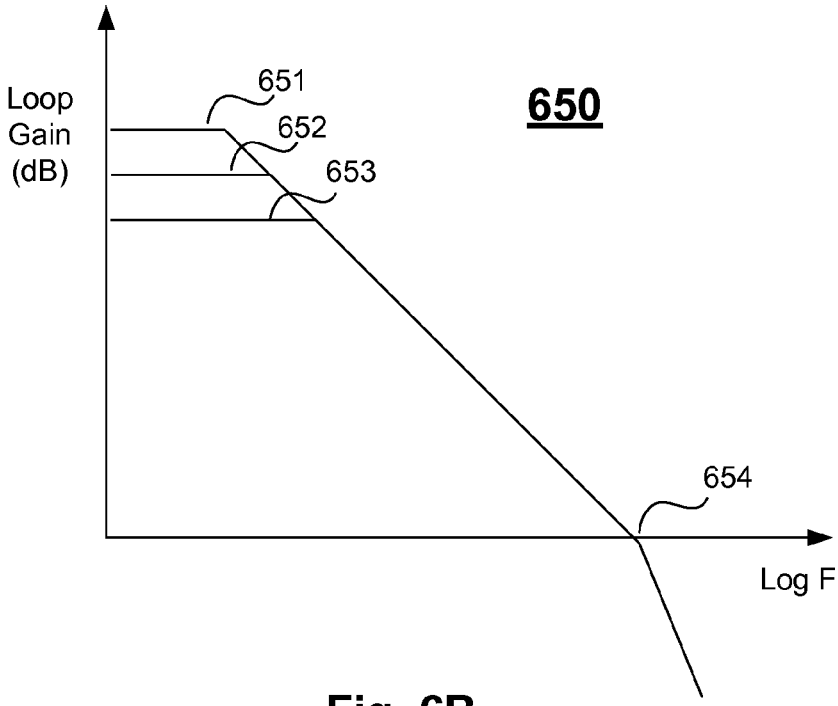
FIG. 6B illustrates a graph having frequency plots depicting the loop gain associated with different loading of the voltage regulator of FIG. 6A.

FIG. 6B illustrates a graph 650 having frequency plots 651-653 depicting the loop gain associated with different load currents from the voltage regulator 600 of FIG. 6A. The constant GM has fixed GBW at point 654 such that regulator 600 of FIG. 6A remains stable for the $I_2$ range of interest ($I_{load}$≈$I_2$). The GBW remains less than all other poles. Regulator 600 may have sufficient phase margin and remain stable for a wider range of load currents. The value of $C_{load}$ 606 can be used to minimize cost and area.

Figure 7A:
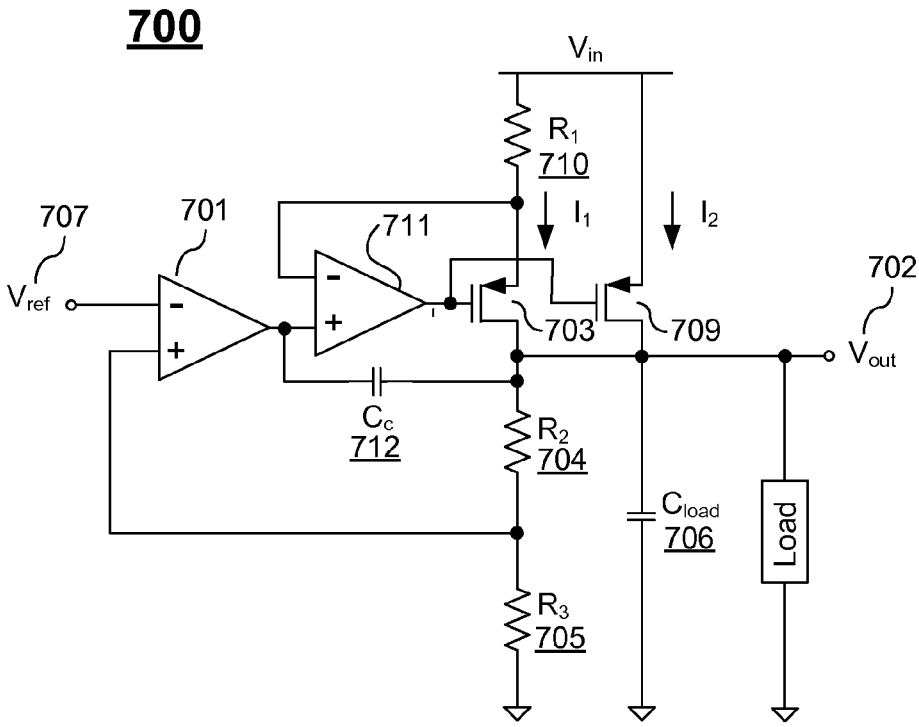
FIG. 7A illustrates a regulator according to another embodiment of the present invention.

FIG. 7A illustrates a regulator according to another embodiment of the present invention. Regulator 700 is similar to regulator 600 with the exception of a feedback capacitor $C_c$ 712. The left side of capacitor $C_c$ can be coupled back to the output of amplifier 701 (usually referred to as Miller feedback), as shown in FIG. 7A, or can be also be coupled back to the source of a common gate stage inside amplifier 701 whose drain is coupled to the output of 701 (usually referred to as Ahuja feedback). In both cases, the GM of the output stage will remain constant across a wider range of load currents. Since GM is constant, the second pole of this regulator will remain constant with load current, and if designed to be higher than the GBW, the constant GM will allow regulator 700 to be stable over the wider range of load currents.

Figure 7B:
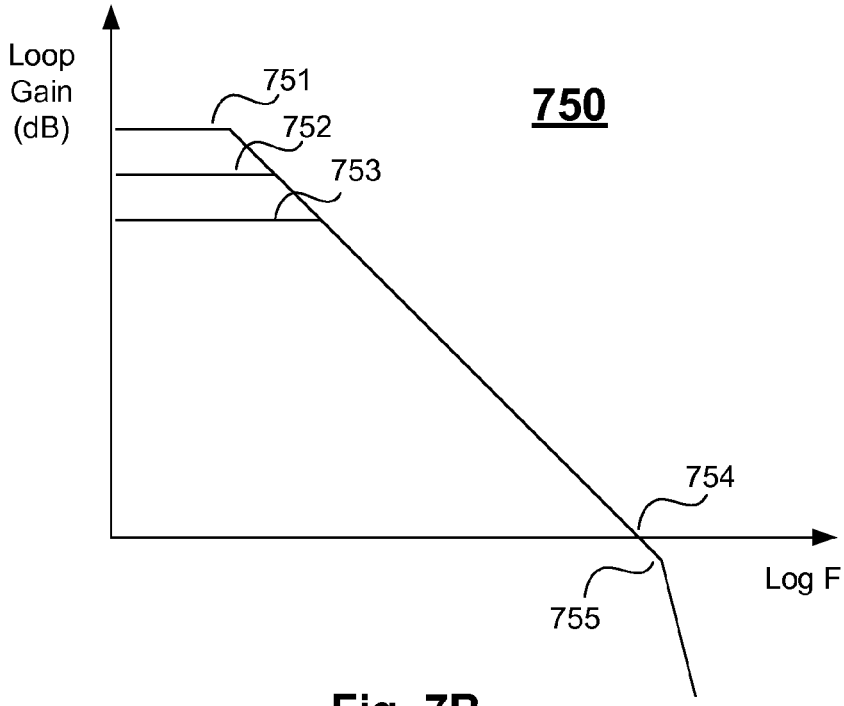
FIG. 7B illustrates a graph having frequency plots depicting the loop gain associated with different loading of the voltage regulator of FIG. 7A.

FIG. 7B illustrates a graph 750 having frequency plots 751-753 depicting the loop gain associated with different current loading of the voltage regulator 700 of FIG. 7A. Graph 750 shows that a second pole is fixed across load currents at point 755 and does not interfere with the GBW which is fixed across load currents at point 754.

With constant GM, the $2^{nd}$ order pole (at point 755) determined by GM/$C_{load}$ will remain fixed regardless of the value of the load current. GM can be selected such that GM/$C_{load}$ will always be greater than the GBW of the regulator 700. This may make LDO regulator 700 unconditionally stable. Regulator 700 may be stable for small load currents of a few microamperes or even zero microamperes. Accordingly, higher resistance resistor values may be used for the voltage dividers minimize the quiescent current in the LDO regulator 700 without affecting stability.

Figure 8A:
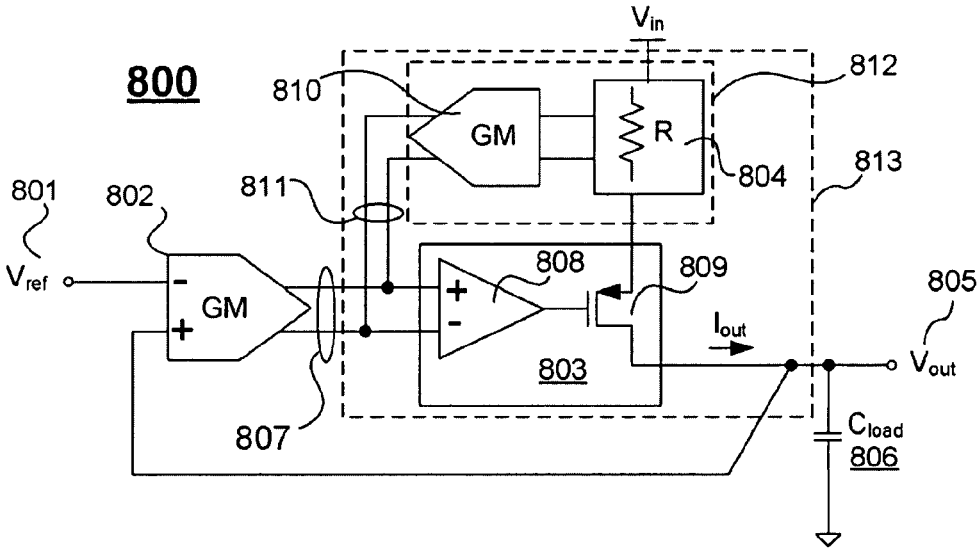
FIG. 8A illustrates another regulator according to another embodiment of the present invention.

FIG. 8A illustrates another regulator 800 according to another embodiment of the present invention. While the previous circuits described in FIG. 4, FIG. 6A, and FIG. 7A rely on comparing the voltage at the output of the first stage voltage amplifier to the voltage that is fed back from the resistor network, the circuit of FIG. 8A relies on comparing the differential current 807 at the output of the first stage transconductance stage 802, with the differential output current 811 that is generated by a second transconductance stage 810 whose input has been coupled to the resistor network 804. Regulator 800 includes a differential current to single ended current converter (ΔI-to-I converter) 813, transconductance gain stage 802, and load capacitor ($C_{load}$) 806. The ΔI-to-I converter 813 includes transconductance stage 803 (GM stage), a feedback network 812, and second transconductance stage 810.

In this embodiment, feedback network 812 provides a differential current 811 corresponding to $I_{out}$. Current sensing element 804 converts $I_{out}$ to a voltage at the input of GM stage 810. GM stage 810 provides differential currents 811 that is proportional to that voltage, hence 811 is proportional to $I_{out}$. Gain stage 802 provides differential error current that is proportional to its input voltage. In this closed loop configuration, the sum of the differential currents 807 and 811 must equal zero, so it is necessary that input voltage of 802 be linearly proportional to the output current $I_{out}$. So it is shown that the circuit 800 provides an output current that is proportional to the input voltage of GM stage 802, and the ratio between the output current and the input voltage is not dependent on the DC value of the output current.

Figure 8B:
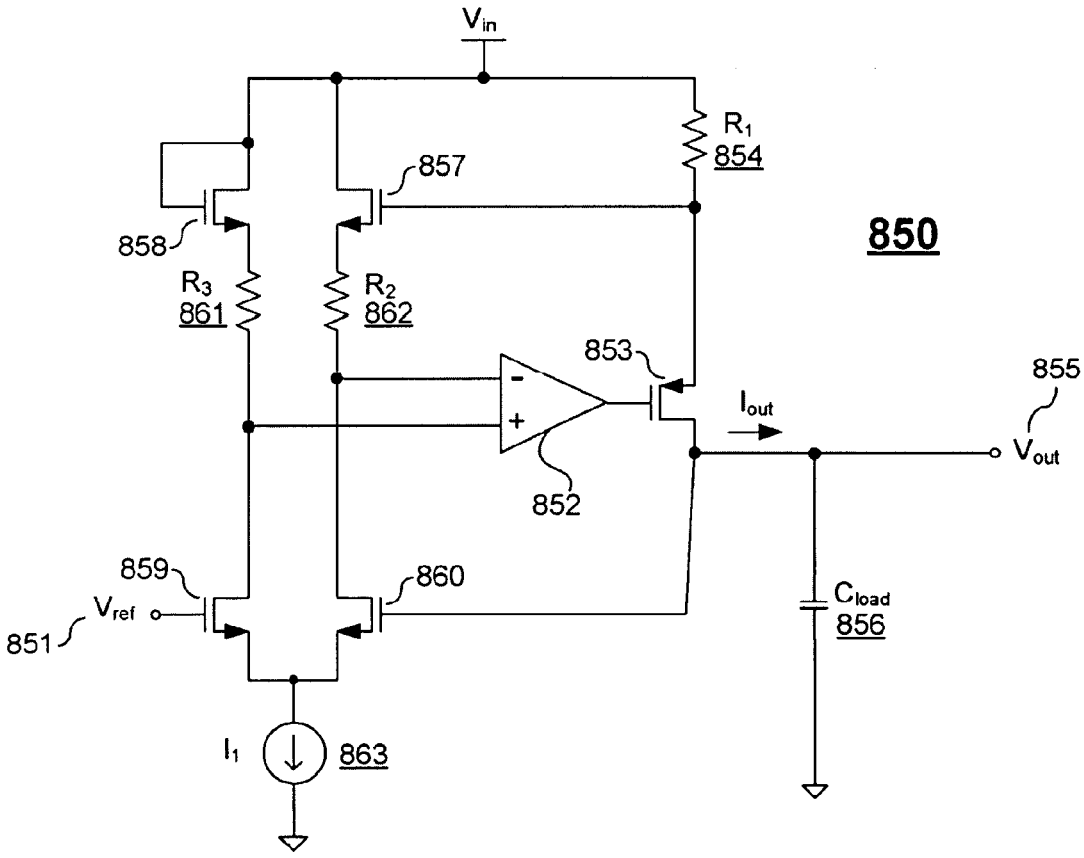
FIG. 8B illustrates a detailed implementation of the embodiment of the present invention shown in FIG. 8A.

FIG. 8B illustrates a detailed implementation of one embodiment of the present invention shown in FIG. 8A. Transistors 859, transistor 860, and current source 863 form GM stage 802 of FIG. 8A. Amplifier 852, transistor 853, resistor 854, and capacitor 856 correspond to amplifier 808, transistor 809, current sensing element 804, and capacitor 806 of FIG. 8A (respectively). Transistors 858 and 857, and resistors 861 and 862, form GM stage 810 of FIG. 8A.

Transistors 859 and transistor 860 form a differential pair that steers the current $I_1$ from current source 863 depending on whether $V_{out}$ 855 is above $V_{ref}$ 851 or below. Transistor 858 and resistor 861 form a load for the current passing though the channel of transistor 859 and transistor 857 and resistor 862 form a load for the current passing through the channel of transistor 860.

If a load draws more current, the voltage on the output terminal of the regulator will begin to drop. As Vout drops, transistor 860 will begin to turn off. As this transistor turns off, it will steer more current into resistor R3 and more away from R2. This forces a negative differential voltage to appear across the input of amplifier 852, which lowers the gate voltage of transistor 853 to turn it on harder to try to regulate the output. As more current flows into R1 (854), the gate voltage of 857 will drop the current through R2 until it exactly equal the current in 860, and the current through R3 exactly equals the current in 859, and the input differential voltage of op amp 852 is zero. At this moment, the difference in current between transistor 859 and 860 should be the same as the difference between the IR drops of R3 (861) and R2 (862). This difference in IR drop should also be equal the voltage drop across R1 (854) (to first order if the voltage across 857 and 858 are the same). And if R2=R3, the voltage across R1, which is equal to $I_{out}$*R1 will also be proportional to the difference in current between R2 and R3, which is the same the difference in current between transistors 860 and 859. Thus the difference in current between 860 and 859 will be linearly proportional to the output current. Hence this is a linear ΔI-to-I converter as described by 813 of FIG. 8A. The current gain between the input differential current and single-ended output current is determined mainly by the ratio of R1/R2, or R1/R3 (since R2=R3), and will not change with the DC value of Iout. Thus this circuit implements a constant GM regulator whose GM is given by the transconductance of input stage (859, 860) times the R1/R2 ratio.

The above description illustrates various embodiments of the present invention along with examples of how aspects of the present invention may be implemented. The above examples and embodiments should not be deemed to be the only embodiments, and are presented to illustrate the flexibility and advantages of the present invention as defined by the following claims. For example, while the above examples have been illustrated using the polarities and device types set forth above, it is to be understood that opposite polarities and other device types may be used. Based on the above disclosure and the following claims, other arrangements, embodiments, implementations and equivalents may be employed without departing from the scope of the invention as defined by the claims.

What is claimed is:

1. A voltage regulator circuit comprising:

an input terminal coupled to receive an input voltage;

an output terminal coupled to a load;

a gain stage having a first input coupled to a reference voltage, a second input coupled to the output terminal of the voltage regulator circuit, and an output terminal for providing a difference signal between the reference voltage and a regulator output voltage; and a voltage to current converter having a first input coupled to the input terminal of the voltage regulator circuit for receiving the input voltage, a second input coupled to the output terminal of the gain stage, and an output coupled to the output terminal of the voltage regulator circuit for providing an output current into the load, wherein the voltage to current converter includes:

an amplifier having a first input coupled to the output terminal of the gain stage, a second input, and an output;

a resistor having a first terminal coupled to the input terminal of the voltage regulator circuit and a second terminal coupled to the second input of the amplifier;

and a transistor having a control terminal coupled to the output of the amplifier, a first terminal coupled to the second terminal of the resistor, and a second terminal coupled to the output terminal of the voltage regulator circuit, and wherein a transconductance of the voltage to current converter is constant across a range of values of the output current.

2. The circuit of claim 1 wherein the gain stage comprises a differential output.

3. The circuit of claim 1 wherein the voltage to current converter includes a feedback network coupled to provide a feedback signal corresponding to the output current.

4. The circuit of claim 3 wherein the feedback network includes the resistor.

5. The circuit of claim 3 wherein the feedback network includes the resistor, and wherein the gain circuit includes differential outputs coupled to the first input of the amplifier in the voltage to current converter, and wherein the feedback network includes differential outputs coupled to the amplifier, and wherein the transconductance of the voltage to current converter is inversely proportional to the value of the resistor.

6. The circuit of claim 1, wherein the second input of the gain stage is coupled to the output terminal of the voltage regulator circuit through a resistor divider.

7. The circuit of claim 1 further comprising a second transistor having a control terminal coupled to the output of the amplifier, a first terminal coupled to the input terminal of the voltage regulator circuit, and a second terminal coupled to the output terminal of the voltage regulator circuit.

8. The circuit of claim 1 further comprising a capacitor having a first terminal coupled to the first input of the amplifier and a second terminal coupled to the output of the voltage regulator circuit.

9. A voltage regulator circuit comprising:

an input terminal coupled to receive an input voltage;

an output terminal coupled to a load;

a gain stage having a first input coupled to a reference voltage, a second input coupled to the output terminal of the voltage regulator circuit, and an output terminal for providing a difference signal between the reference voltage and a regulator output voltage; and a first voltage to current converter having a first input coupled to the input terminal of the voltage regulator circuit for receiving the input voltage, a second input coupled to the output terminal of the gain stage, and an output coupled to the output terminal voltage regulator circuit for providing an output current into the load, wherein the first voltage to current converter includes:

a network coupled to the input terminal of the voltage regulator circuit, the network generating a voltage proportional to the output current;

a second voltage to current converter coupled to the network for receiving the voltage proportional to the output current;

an amplifier coupled to receive an output of the second voltage to current converter; and a transistor having a control terminal coupled to an output of the amplifier, a first terminal coupled to the network, and a second terminal coupled to the output terminal of the voltage regulator circuit, wherein the gain stage is a third voltage to current converter and the difference signal is a difference current, and wherein current from the second voltage to current converter is combined with current from the third voltage to current converter at the input of the amplifier, and a transconductance of the first voltage to current converter is constant across a range of values of the output current.

10. The circuit of claim 9 wherein:

the network comprises a first resistor;

the second voltage to current converter comprises a first transistor, a second transistor, a second resistor, and a third resistor, the first transistor having a control terminal coupled to the first resistor, a first terminal coupled to the input terminal of the regulator, and a second terminal coupled to a first input of the amplifier through the second resistor, the second transistor having a control terminal and a first terminal coupled to the input terminal of the voltage regulator circuit, and a second terminal coupled to a second input of the amplifier through the third resistor; and the gain stage comprises a third transistor and fourth transistor, wherein the third transistor has a control terminal coupled to the output terminal of the voltage regulator circuit and a first terminal coupled to the first input of the amplifier, and wherein the fourth transistor has a control terminal coupled to the reference voltage and a first terminal coupled to the second input of the amplifier.

11. A method comprising:

receiving an input voltage at an input terminal of a regulator, the regulator generating an output voltage;

coupling a reference voltage and the output voltage to a gain stage, and in accordance therewith, generating a difference signal;

converting the input voltage to an output current of the regulator, wherein the output current is proportional to a difference between the input voltage and the difference signal;

coupling an input current of the regulator through a transistor; and coupling the input current of the regulator through a network to generate a first voltage proportional to the output current;

converting the first voltage to a first current; and combining said difference signal and the first current to generate a control signal for controlling a control terminal of the transistor, wherein a transconductance of the conversion of the input voltage to the output current is constant across a range of values of the output current.

12. The method of claim 11, wherein the first current is a differential current, wherein the difference signal is a differential current, and wherein the combined difference signal and first current are amplified to generate a control voltage.

13. A method comprising:

receiving an input voltage at an input terminal of a regulator, the regulator generating an output voltage;

coupling a reference voltage and the output voltage to a gain stage, and in accordance therewith, generating a difference signal;

converting the input voltage to an output current of the regulator, wherein the output current is proportional to a difference between the input voltage and the difference signal;

coupling an input current of the regulator through a resistor to generate a first voltage;

coupling the input current of the regulator through a transistor; and controlling a control terminal of the transistor using a difference between the first voltage and the difference signal, wherein a transconductance of the conversion of the input voltage to the output current is constant across a range of values of the output current.

14. The method of claim 13, wherein the difference signal is a differential signal.

15. The method of claim 13, wherein the difference signal is a voltage.

16. The method of claim 13, wherein the difference signal is a differential current.

17. The method of claim 13, wherein converting the input voltage to the output current comprises coupling the input voltage and output voltage across a feedback network.

18. The method of claim 17, wherein the feedback network includes a resistor.

19. The method of claim 18, wherein a transconductance of the conversion is inversely proportional to the value of the resistor.

20. The method of claim 13, further comprising amplifying the output current.

* * * * *